United States Patent [19]

Furukawa et al.

[11] Patent Number: 5,010,977

[45] Date of Patent: Apr. 30, 1991

[54] ACOUSTIC APPARATUS WITH PLURAL RESONATORS HAVING DIFFERENT RESONANCE FREQUENCIES

[75] Inventors: Kazunari Furukawa; Daisuke Suzuki, both of Hamamatsu, Japan

[73] Assignee: Yamaha Corporation, Hamamatsu, Japan

[21] Appl. No.: 379,583

[22] Filed: Jul. 13, 1989

[30] Foreign Application Priority Data

Jul. 22, 1988 [JP] Japan ..... 63-96436[U]

[51] Int. Cl.[5] ..... G10K 11/04

[52] U.S. Cl. ..... 181/160; 181/150; 181/156; 181/199; 381/96; 381/159

[58] Field of Search ..... 181/148, 150, 156, 160, 181/165, 199; 381/159, 96, 100, 103, 106, 108, 120, 121, 153, 154, 158, 162

[56] References Cited

U.S. PATENT DOCUMENTS

| | | | |
|---|---|---|---|
| 1,969,704 | 8/1934 | D'Alton | 181/160 |
| 4,126,204 | 11/1978 | Ogi et al. | 181/156 |
| 4,301,332 | 11/1981 | Dusanek | 381/158 |
| 4,409,588 | 10/1983 | Hofer et al. | 181/160 X |
| 4,549,631 | 10/1985 | Bose | 181/155 |
| 4,875,546 | 10/1989 | Konar | 181/160 |

FOREIGN PATENT DOCUMENTS

| | | | |
|---|---|---|---|
| 590446 | 1/1960 | Canada | 181/160 |
| 0125625 | 5/1984 | European Pat. Off. . | |
| 3221414 | 12/1983 | Fed. Rep. of Germany | 381/159 |
| 2555389 | 5/1985 | France | 381/159 |
| 61-20490 | 1/1986 | Japan | 381/159 |
| 696671 | 9/1950 | United Kingdom . | |

*Primary Examiner*—Benjamin R. Fuller

*Attorney, Agent, or Firm*—Spensley Horn Jubas & Lubitz

[57] ABSTRACT

An acoustic apparatus comprises a plurality of resonators having different resonance frequencies, each of which is constituted by a closed cavity and acoustic mass for causing the cavity to acoustically communicate with an external region. A housing enclosing the plurality cavities is integrally formed. Resonance acoustic radiation portions of the resonators are arranged adjacent to each other on one side of the housing, whereby sound sources which correspond to the acoustic mass can be concentrated.

8 Claims, 7 Drawing Sheets

ACOUSTIC APPARATUS WITH PLURAL RESONATORS HAVING DIFFERENT RESONANCE FREQUENCIES

BACKGROUND OF THE INVENTION

1. Field of the Invention

The present invention relates to an acoustic apparatus for generating an acoustic wave obtained by synthesizing resonant acoustic waves radiated from a plurality of resonators having different resonance frequencies.

2. Description of the Prior Art

As a conventional acoustic apparatus of this type, a speaker system with a port disclosed in U.S. Pat. No. 4,549,631 is known. FIG. 12 shows an arrangement when the speaker system in U.S. Pat. No. 4,549,631 is put into a practical application. In the speaker system shown in FIG. 12, an internal space of a cabinet 1 having a known rectangular section is partitioned into two chambers 1*a* and 1*b* by a partition plate 2. Opening ports 3*a* and 3*b* are disposed on the outer walls of the chambers 1*a* and 1*b*, respectively, so that the chamber 1*a* and the opening port 3*a* and the chamber 1*b* and the opening port 3*b* form two Helmholtz resonators. In these Helmholtz resonators, resonance frequencies defined by the air springs in the chambers 1*a* and 1*b* as closed cavities and air masses of sound paths 4*a* and 4*b* of the opening ports 3*a* and 3*b* as acoustic mass means are respectively set to be $f_1$ and $f_2$ ($f_1 < f_2$). An opening 2*a* is formed in the partition plate 2, and a vibrator (dynamic speaker unit) 5 is mounted in this opening 2*a*. A diaphragm 6 of the vibrator 5 is mounted to close the opening 2*a*. The front surface of the diaphragm 6 opposes the chamber 1*a*, and its rear surface opposes the chamber 1*b*.

Since this speaker system drives the resonators by the front and rear surfaces, the directions of resonance radiation from the two resonators are opposite to each other. For this reason, in a system arrangement, acoustic radiation spaces for the two, i.e., front and rear surfaces must be taken into consideration, and this speaker system has no single-sidedness as in normal speaker system. Although directivity is approximate to a nondirectional characteristic in a bass range, a user experiences sounds produced from two different positions at a normal audible distance. As a result, a sound source position becomes unclear, i.e., a sound image is dispersed.

Note that in a speaker system shown in FIG. 1 of U.S. Pat. No. 4,549,631, since opening ports are disposed on a single surface of a cabinet, the first problem, i.e., no single-sidedness in the system arrangement can be solved. However, since the opening ports are disposed to be horizontally or vertically separate from each other with respect to the vibrator 5, the second problem, i.e., dispersion of a sound image is left unsolved. A similar speaker system is also shown in the European Patent Publication (A1) No. 0125625.

SUMMARY OF THE INVENTION

The present invention has been made in consideration of the conventional problems, and has as its object to provide an acoustic apparatus which has a plurality of resonators whose cavities are formed in a single housing and which have different resonance frequencies, and which generates an acoustic wave obtained by synthesizing resonance sounds from these resonators, wherein the single-sidedness of the system arrangement can be achieved and sound sources can be concentrated.

In order to achieve the above object of the present invention, resonance sound acoustic radiation portions of the plurality of resonators are arranged on a single side of the housing to be adjacent to each other.

In order to arrange the resonance sound acoustic radiation portions on the single side to be adjacent to each other, the resonance sound acoustic radiation portions are coaxially arranged or juxtaposed.

According to an aspect of the present invention, the plurality of resonators are driven by a single vibrator. The vibrator is driven to cancel an air counteraction from the resonators when the resonators are driven.

As a drive means for canceling the air counteraction, a known circuit, e.g., a negative impedance generator for generating a negative impedance component ($-Z_0$) in an output impedance and driving a vibrator to cancel an internal impedance inherent in the vibrator, a motional feedback (MFB) circuit for detecting a motional signal corresponding to a movement of a vibrating body of a vibrator by a certain means to negatively feed back the detected signal to an input side, or the like, can be employed.

According to the present invention, since resonance sound acoustic radiation portions are arranged on a single side of a housing to be adjacent to each other, single-sidedness of a system can be realized, and the apparatus of the present invention can be used like a conventional system. In addition, sound sources are concentrated, and a sound image can become clear. That is, so-called sound image localization can be improved.

In an acoustic apparatus of this type, since an output sound pressure is proportional to an acceleration, if the resonance Q value remains the same, an output sound pressure at a resonance frequency is increased as the resonance frequency is increased. Therefore, in order to obtain flat frequency characteristics of an output sound pressure as a speaker system, the resonance Q value of a resonator having a lower resonance frequency must be increased. However, since the speaker system of this type is constant-voltage driven by a power amplifier having an essentially zero output impedance, the Q value of the resonator is influenced by the volume of a cavity. In a cavity volume range as large as a popular speaker cabinet, the Q value tends to be increased as a cavity volume is increased if the resonance frequency remains the same or as the resonance frequency is increased if the cavity volume remains the same. For this reason, in a speaker system shown in FIG. 12 (to be referred to as a double-resonator type speaker system hereinafter), the volumes of the cavities 1*a* and 1*b* and the opening ports 3*a* and 3*b* are designed as follows. That is, in this system, (the volume of the cavity 1*a*) >> (the volume of the cavity 1*b*) is set so that the Q value of a resonator having a lower resonance frequency is increased, thus increasing an output sound pressure at the frequency $f_1$. Meanwhile, a resonator having a higher resonance frequency has a relatively small Q value so that an output sound pressure at the frequency $f_2$ matches with the output sound pressure at the frequency $f_1$.

More specifically, in the conventional double-resonator type speaker system which is premised on constant-voltage driving, the size of the cabinet 1 is associated with the Q value at the frequency $f_1$, and it is difficult to make the cabinet compact in size.

In one aspect of the present invention, the vibrator for driving the plurality of resonators is driven to cancel an air counteraction from the resonators upon driving of the resonators. A state wherein the air counteraction from the resonators is perfectly canceled will be described below. In this state, the vibrator is not influenced by the air counteraction from the resonator side, i.e., cavity side, and the vibrating body of the vibrator is converted to an equivalent wall which cannot be driven by the resonator side viewed from the resonators. Therefore, the Q value of the Helmholtz resonator is not influenced by the characteristics of the vibrator, and theoretically becomes $\infty$ if the equivalent resistances of the cavities and opening ports are ignored. When the air counteraction is not completely canceled or when the equivalent resistances of the cavities and opening ports cannot be ignored, the Q value takes an intermediate value between $\infty$ and a Q value obtained when the vibrator is constant-voltage driven. Thus, according to the present invention, if the cavity is reduced or if the resonance frequency is decreased, a sufficiently high Q value can be assured.

More specifically, according to the present invention, the housing and the system can be made compact without impairing bass sound radiation characteristics. In particular, since the acoustic apparatus of the present invention has a plurality of resonance cavities, if the resonators are made compact, the housing and the system can be effectively rendered compact.

DETAILED DESCRIPTION OF THE PREFERRED EMBODIMENTS

Figure 1:
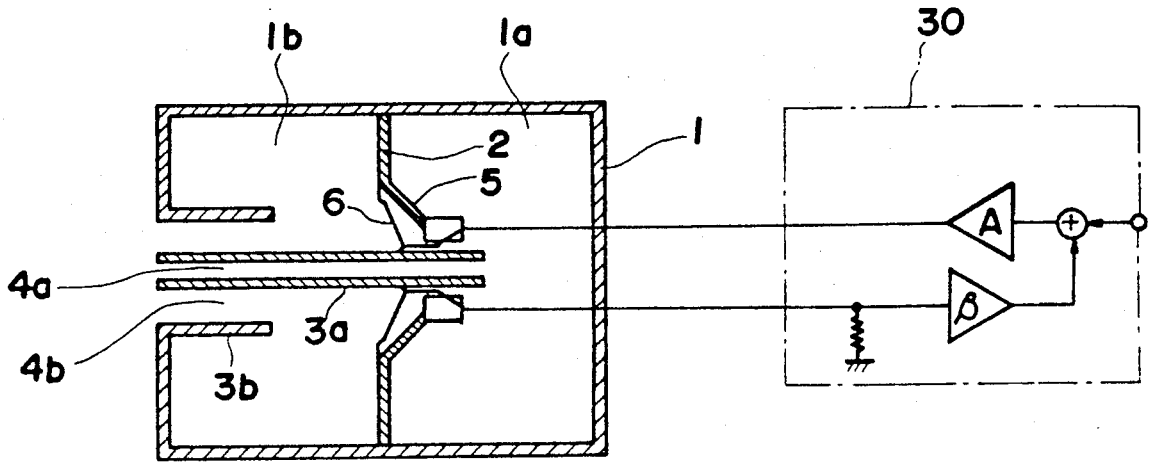
FIG. 1 is a schematic view of an acoustic apparatus according to an embodiment of the present invention.

An embodiment of the present invention will now be described with reference to the accompanying drawings. Note that the same reference numerals denote the common or corresponding parts in the prior art.

Figure 12:
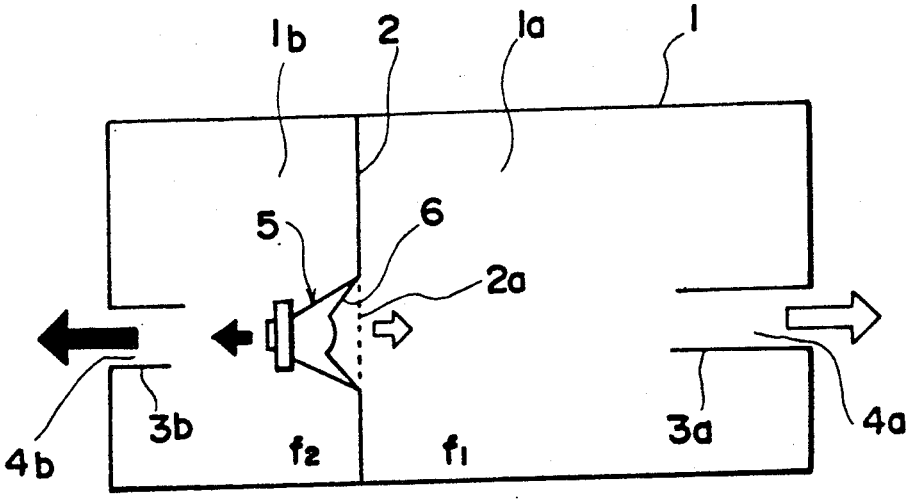
FIG. 12 PRIOR ART
FIG. 12 is a sectional view showing an arrangement of a conventional double-resonator type speaker system.

FIG. 1 shows an arrangement of an acoustic apparatus according to an embodiment of the present invention. In the acoustic apparatus shown in FIG. 1, unlike in the apparatus shown in FIG. 12, the direction of a vibrator (dynamic speaker unit) 5 is reversed, so that the front surface of the vibrator 5 opposes a chamber 1*b*, and its rear surface opposes a chamber 1*a*. An opening port 3*a* is not open to an outer wall of the chamber 1*a* toward an external region but starts from the interior of the chamber 1*a* and extends through the center of the vibrator 5 from the rear surface side to the front surface side. Furthermore, the port 3*a* coaxially extends in an opening port 3*b* to an external open end of the opening port 3*b* and is open to be even with the external open end.

In the acoustic apparatus shown in FIG. 1, the chamber 1*a* and the opening port 3*a* constitute a first Helmholtz resonator, and its resonance frequency $f_1$ can be obtained by:

$$f_1 = \frac{c}{2\pi} \cdot \sqrt{\frac{S_1}{l_1 V_1}} \tag{1}$$

The chamber 1*b* and the opening port 3*b* constitute a second Helmholtz resonator, and its resonance frequency $f_2$ can be obtained by:

$$f_2 = \frac{c}{2\pi} \cdot \sqrt{\frac{S_2}{l_2 V_2}} \tag{2}$$

where $V_1$ is the volume of the chamber 1*a*, $S_1$ is the sectional area of the opening port 3*a*, $l_1$ is the length of the opening port 3*a*, $V_2$ is the volume of the chamber 1*b*, $S_2$ is the sectional area of the opening port 3*b*, $l_2$ is the length of the opening port 3*b*, and c is the sonic speed.

Figure 2:
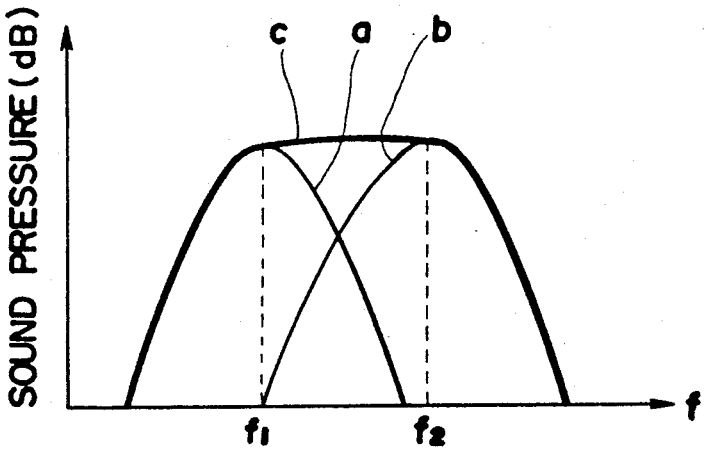
FIG. 2 is a graph showing output sound pressure-frequency characteristics of the apparatus shown in FIG. 1.

The speaker unit 5 is driven by a vibrator driver 30, and resonators are driven by the speaker unit 5, so that resonance acoustic waves are output from the opening ports 3*a* and 3*b* at output sound pressures indicated by solid curves a and b in FIG. 2. In this case, the first Helmholtz resonator is driven in a phase opposite to that of the second Helmholtz resonator on the rear surface side of a diaphragm 6. However, in these Helmholtz resonators, since the output sound pressures from the opening ports are inverted at frequencies higher than the resonance frequencies of the resonators, the resonance acoustic waves output from both the resonators are in-phase with each other and added between the frequencies $f_1$ and $f_2$. As a result, in a state with ideal characteristic values, e.g., ideal Q values, resonance frequencies, and the like of resonators, flat total frequency characteristics can be obtained between the frequencies $f_1$ and $f_2$, as indicated by thick curve c in FIG. 2. More specifically, in a double-resonator type speaker system, superposed portions of two resonance characteristics can be in-phase added to each other, thus expanding a frequency band. In particular, since each characteristic element exhibits a single-humped resonance characteristic, the effect of expansion of the frequency band by this addition is remarkable. In this embodiment, since two opening ports 3*a* and 3*b* are coaxially arranged, two resonance sounds are apparently output from a single port, and sound localization can be effectively improved by concentrating sound sources.

In the speaker system of this type, as shown in FIG. 2, it is ideal that output sound pressures from the opening ports 3*a* and 3*b* are equal to each other at the frequencies $f_1$ and $f_2$, and are synthesized to generate a flat total sound pressure between the frequencies $f_1$ and $f_2$. However, in order to achieve this, as described above, the Q values must be set to be appropriate values, such that a Q value $Q_1$ at the frequency $f_1$ is set to be higher than a Q value $Q_2$ at the frequency $f_2$, and the like. In order to set such Q values, a conventional apparatus which constant-voltage drives the speaker unit 5 has limitations in that the chamber 1*a* must be considerably increased in size. Thus, it is difficult to make the apparatus compact.

In the acoustic apparatus shown in FIG. 1, as the vibrator driver 30 for driving the vibrator 5, the driver 30 including a negative impedance in an output impedance is used.

Figure 3:
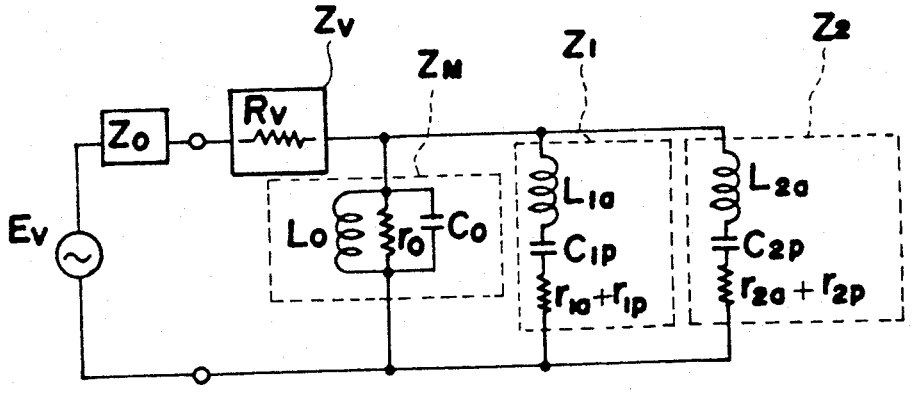
FIG. 3 is an electrically equivalent circuit diagram of the apparatus shown in FIG. 1.
Figure 4:
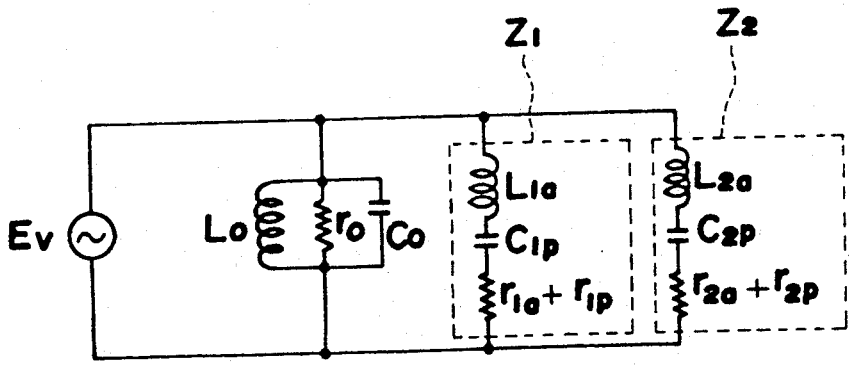
FIG. 4 is an electrically equivalent circuit diagram when $Z_V - Z_0 = 0$ in FIG. 3.

FIG. 3 shows an equivalent circuit of FIG. 1. FIG. 4 shows an electrically equivalent circuit when $Z_V - Z_0 = 0$ in FIG. 3. In FIG. 3, a parallel resonance circuit $Z_M$ is formed by an equivalent motional impedance of the vibrator 5. Reference symbol $r_o$ denotes an equivalent resistance of a vibration system; $L_o$, an equivalent inductance (or a reciprocal number of an equivalent stiffness) of the vibration system; and $C_o$, an equivalent capacitance (or equivalent mass) of the vibration system. A series resonance circuit $Z_1$ is formed by an equivalent motional impedance of the first Helmholtz resonator. Reference symbol $r_{1a}$ denotes an equivalent resistance of the chamber 1*a* as the cavity of the resonator; $L_{1a}$, an equivalent inductance (or a reciprocal number of an equivalent stiffness) of this cavity; $r_{1p}$, an equivalent resistance of the opening port 3*a*; and $C_{1p}$, an equivalent capacitance (or equivalent mass) of the opening port 3*a*. A series resonance circuit $Z_2$ is formed by an equivalent motional impedance of the second Helmholtz resonator. Reference symbol $r_{2a}$ denotes an equivalent resistance of the chamber 1*b* as the cavity of the resonator; $L_{2a}$, an equivalent inductance (or a reciprocal number of an equivalent stiffness) of this cavity; $r_{2p}$, an equivalent resistance of the opening port 3*b*; and $C_{2p}$, an equivalent capacitance (or equivalent mass) of the opening port 3*b*. In FIG. 3, reference symbol $Z_V$ denotes an internal impedance of the vibrator 5. When the vibrator 5 is a dynamic direct radiation speaker, the impedance $Z_V$ mainly serves as a resistance $R_V$ of the voice coil, and slightly includes an inductance. Reference symbol $E_V$ denotes a constant voltage source as a drive source whose output impedance is 0. Note that the equivalent resistances $r_{1a}$, $r_{1p}$, $r_{2a}$, and $r_{2p}$ are very small negligible values as compared to the resistance $R_V$ of the voice coil.

In a state shown in FIG. 4, two ends of each of the series resonance circuits $Z_1$ and $Z_2$ by the equivalent motional impedance of the Helmholtz resonators are short-circuited in an AC manner. Therefore, equivalent resistors equivalently connected in series with these series resonance circuits $Z_1$ and $Z_2$ are only $r_{1a}$, $r_{1p}$, $r_{2a}$, and $r_{2p}$. Thus, the Q values of these series resonance circuits $Z_1$ and $Z_2$ become $R_V/(r_{1a}+r_{1p})$ and $R_V/(r_{2a}+r_{2p})$ times of the corresponding Q values obtained when the apparatus is constant-voltage driven. Since the resistances of these equivalent resistors $r_{1a}$, $r_{1p}$, $r_{2a}$, and $r_{2p}$ are negligibly small values as compared to the voice coil resistance $R_V$, the Q values of the series resonance circuits $Z_1$ and $Z_2$ can be greatly increased as compared to those obtained when the apparatus is constant-voltage driven.

Therefore, in the acoustic apparatus shown in FIG. 1, when the Q value at the frequency $f_1$ is decreased by reducing the cavity 1*a* in size, the Q value can be sufficiently increased to exceed a decrease in Q value by setting a negative impedance of the driver 30 at the frequency $f_1$. Note that these Q values can be easily decreased by elongating the opening ports or attaching damping materials on the walls of the opening ports or cavities. The Q values can also be adjusted by changing the negative output impedance value of the driver 30.

In order to obtain flat frequency characteristics in the acoustic apparatus of this type, the Q value $Q_1$ at the resonance frequency $f_1$ is required to be maximized. When the cavity 1*a* is reduced in size, the $Q_1$ value is decreased. However, in the acoustic apparatus in FIG. 1, even when the volume of the cavity 1*a* is reduced, an appropriate negative impedance is set as the output impedance of the driver 30, so that the resonance Q value $Q_1$ at the resonance frequency $f_1$ can be set to be a sufficiently large value. For this reason, the cabinet can be rendered compact to reduce the system in size.

When the equivalent resistances $r_{2p}$ and $r_{2a}$ of the opening port 3*b* and the cavity 1*b* are increased by using the damping material as described above, or when the output impedance of the driver 30 is caused to have frequency characteristics to increase the output impedance value at the frequency $f_2$ to be higher than the output impedance value at the frequency $f_1$, the resonance Q value $Q_2$ at the resonance frequency $f_2$ is set to be a value lower than $Q_1$. Thus, the output sound pressures at the frequencies $f_1$ and $f_2$ can be set to be equal to each other, as shown in FIG. 2, thus achieving flat total characteristics.

Figure 5:
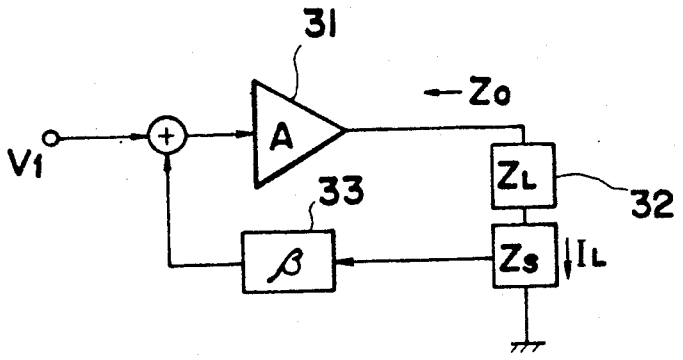
FIG. 5 is a circuit diagram showing a basic arrangement of a negative impedance generator used in the apparatus shown in FIG. 1.

FIG. 5 shows a basic arrangement of a negative impedance generator for negative-impedance driving the vibrator.

In the circuit shown in FIG. 5, an output from an amplifier 31 of a gain A is supplied to a load $Z_L$ as a speaker 32. A current $I_L$ flowing through the load $Z_L$ is detected, and is positively fed back to the amplifier 31 through a feedback circuit 33 of a transmission gain $\beta$. In this manner, an output impedance $Z_0$ of this circuit can be given by:

$$Z_0 = Z_S(1 - A\beta) \tag{3}$$

From equation (3), if $A\beta > 1$, $Z_0$ becomes an open stable type negative impedance. In equation (3), $Z_S$ is the impedance of a sensor for detecting the current.

Therefore, in the circuit shown in FIG. 5, when the type of the impedance $Z_S$ is appropriately selected, the output impedance can include a desired negative impedance component. For example, when the current $I_L$ is detected based on a voltage across the impedance $Z_S$, if the impedance $Z_S$ is a resistance $R_S$, the negative impedance component becomes a negative resistance component; if it is an inductance $L_S$, a negative inductance component; and if it is a capacitance $C_S$, it is a negative capacitance component. The feedback circuit 33 employs an integrator, and the voltage across the inductance $L_S$ is integrated to detect the current, so that the negative impedance component can be a negative resistance component. Furthermore, the feedback circuit 33 employs a differentiator, and a voltage across the capacitance $C_S$ as the impedance $Z_S$ is differentiated to detect the current, so that the negative impedance component becomes a negative resistance component. As the current detection sensor, a current probe such as a C.T., a Hall element, or the like may be used in addition to these impedance elements $R_S$, $L_S$, $C_S$, and the like.

A detailed arrangement corresponding to such a circuit is described in, e.g., Japanese Patent Publication No. Sho 59-51771.

Figure 6:
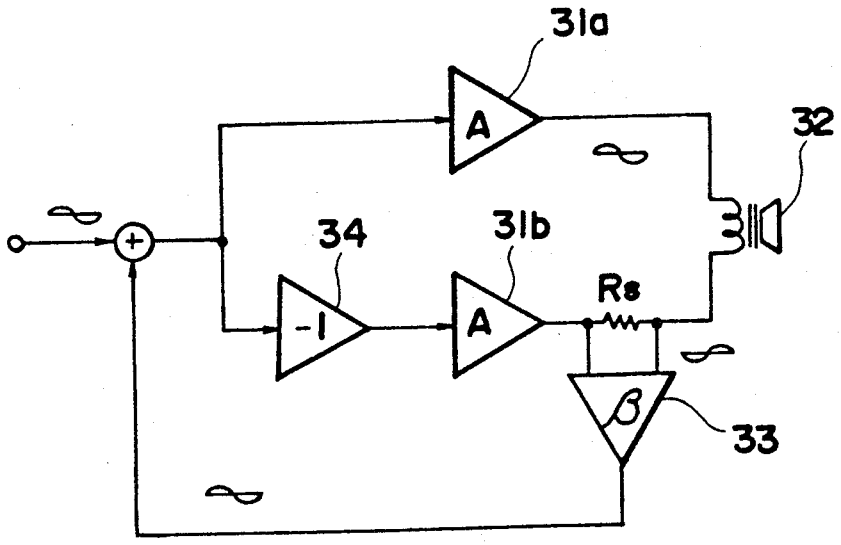
FIGS. 6 to 8 are circuit diagrams showing modifications and detailed arrangements of the negative impedance generator shown in FIG. 5.

Current detection can be performed at a non-ground side of the speaker 32. A detailed arrangement corresponding to such a circuit is described in, e.g., Japanese Patent Publication No. Sho 54-33704. FIG. 6 shows an arrangement of BTL connection, which can be easily applied to the circuit shown in FIG. 5. In FIG. 6, reference numeral 34 denotes an inverter.

Figure 7:
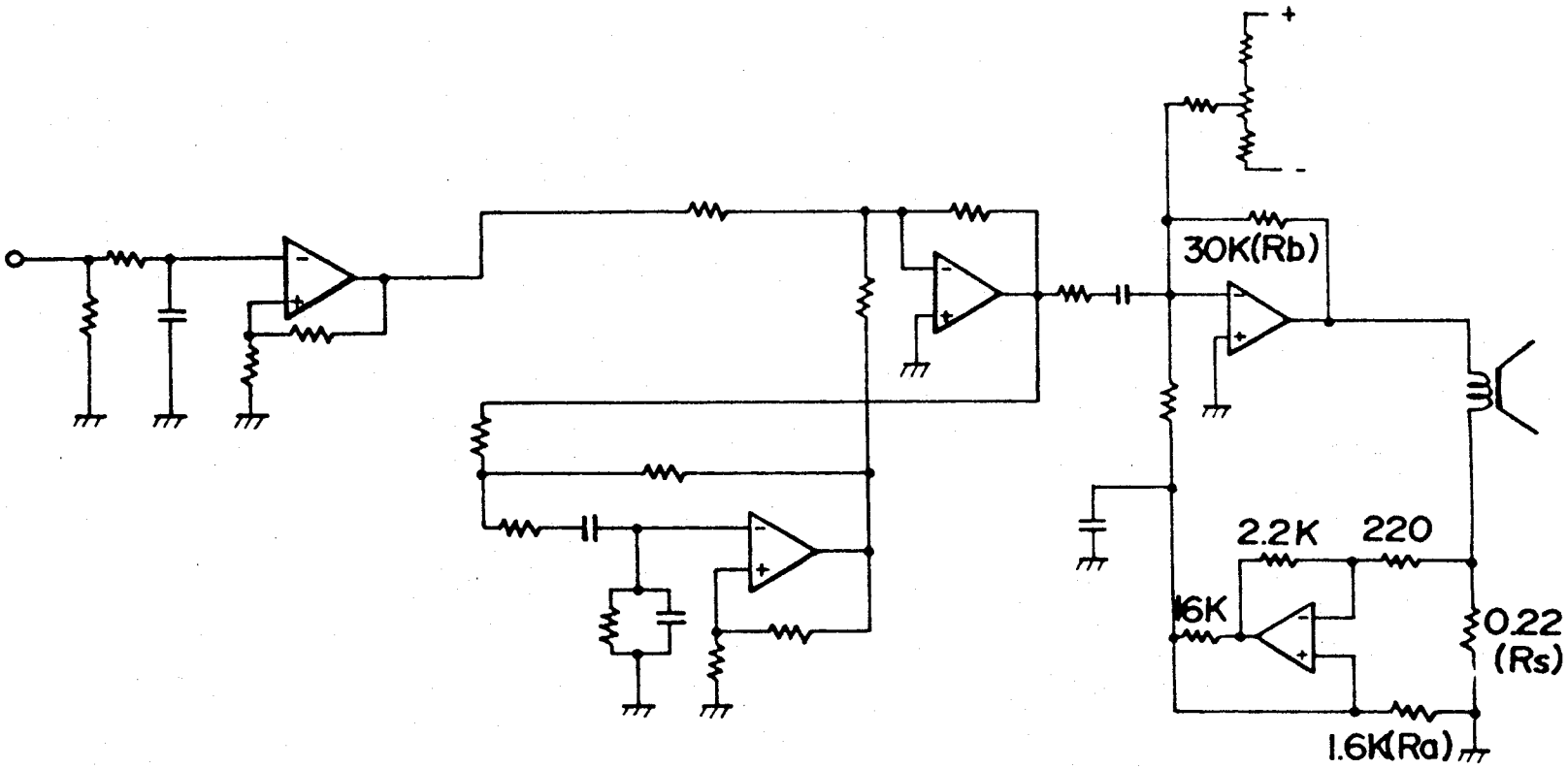

FIG. 7 shows a detailed circuit arrangement of an amplifier which includes a negative resistance component in an output impedance.

An output impedance $Z_0$ of the amplifier shown in FIG. 7 is given by:

$$\begin{aligned} Z_0 &= R_S(1 - R_b/R_a) \\ &= 0.22(1 - 30/1.6) \\ &= -3.19\ (\Omega) \end{aligned}$$

In the circuit shown in FIG. 5, if A, $\beta$, or $Z_S$ is caused to have frequency characteristics, the output impedance $Z_0$ can have frequency characteristics.

Figure 8:
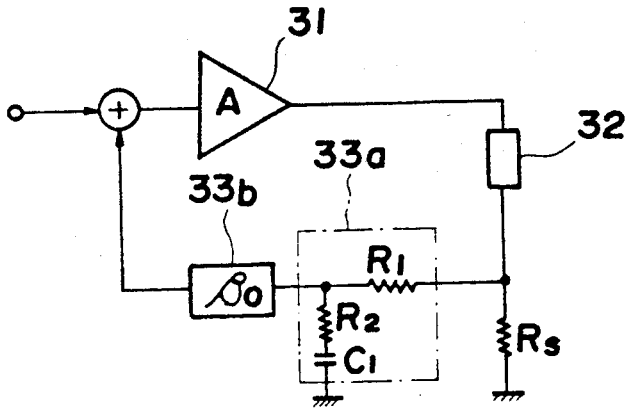
Figure 9:
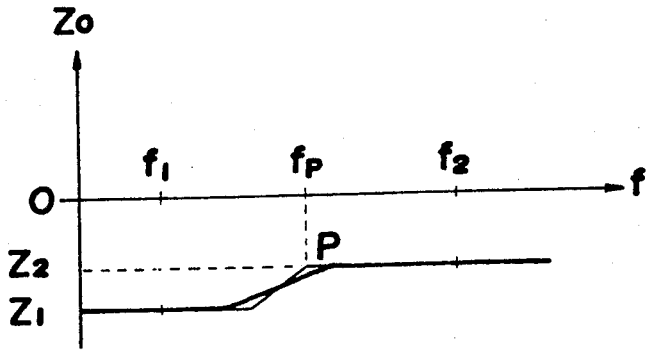
FIG. 9 is a graph showing frequency characteristics of an output impedance of the circuit shown in FIG. 8.

FIG. 8 shows a circuit arrangement when output impedances $Z_1$ and $Z_2$ at the frequencies $f_1$ and $f_2$ can be negative impedances and can be close to each other. The circuit shown in FIG. 8 employs a current detection resistor $R_S$ as a sensor for detecting the current $I_L$, and employs, as the negative feedback circuit 33, a CR circuit 33*a* which consists of a capacitor $C_1$ and resistors $R_1$ and $R_2$ and has frequency characteristics (frequency characteristics in a predetermined band are not flat) and an amplifier 33*b* having no frequency characteristics (frequency characteristics in a predetermined band are flat), so that the transmission gain $\beta$ of the negative feedback circuit 33 has frequency characteristics. In this circuit, if the CR circuit 33*a* is included in the current detection sensor $Z_S$, it can be considered that the sensor $Z_S$ has frequency characteristics. FIG. 9 shows frequency characteristics of the circuit shown in FIG. 8. In FIG. 9, $$Z_2 = R_S\left(1 - A\frac{R_2}{R_1 + R_2}\cdot\beta_0\right)$$

$$Z_1 = R_S(1 - A\beta_o)$$

A frequency $f_P$ at a deflection point P where an output impedance obtained by polygonal-line approximating an output impedance curve according to the Nyquist method falls from $Z_2$ toward $Z_1$ is about $\frac{1}{2}\pi C_1R_2$.

As described above, when the vibrator 5 of the double-resonator type speaker system shown in FIG. 1 is driven by the driver 30 having a negative impedance component in its output impedance, e.g., the driver having the arrangement shown in FIG. 7, the system can be rendered compact.

Another Embodiment

Figure 10:
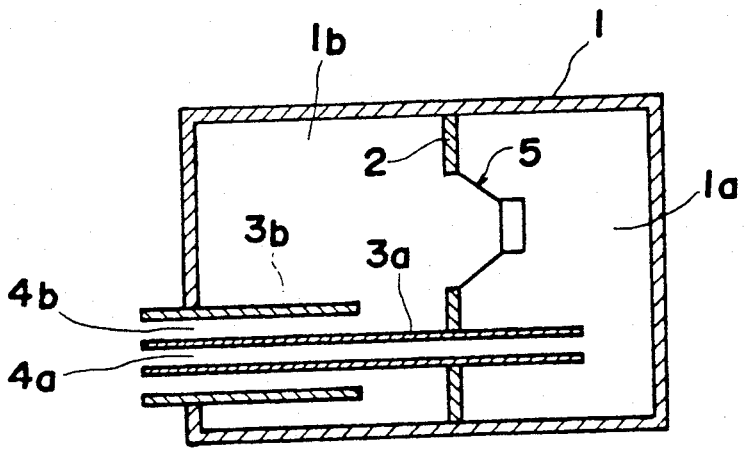
FIGS. 10 and 11 are schematic views showing acoustic apparatuses according to other embodiments of the present invention.
Figure 11:
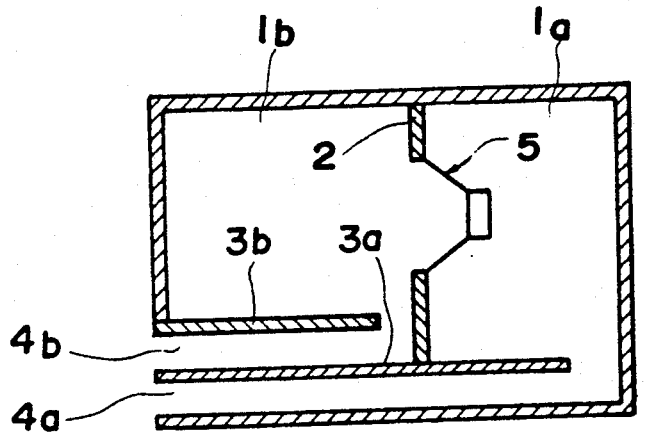

The present invention is not limited to the above embodiment, and various changes and modifications may be made within the spirit and scope of the invention. For example, in the acoustic apparatus shown in FIG. 1, the opening ports 3*a* and 3*b* and the speaker unit 5 are coaxially arranged, and the opening port 3*a* extends through the center of the speaker unit 5. However, as shown in FIG. 10, only the opening ports 3*a* and 3*b* may be coaxially arranged, and the opening port 3*a* may extend through a portion of a partition plate 2 separate from the speaker unit 5. As shown in FIG. 11, the opening ports 3*a* and 3*b* may be juxtaposed. Furthermore, the opening port 3*a* may be divided into a plurality of sections to be open to a circumference having the axis of the opening port 3*a* as the center.

In the above embodiment, the opening port is used as an acoustic mass means constituting the resonator. However, the acoustic mass means may be a passive vibrating body such as a simple opening or a drone cone.

In the above embodiment, the negative impedance generator is used as a vibrator driving means. However, this driving circuit need only drive the vibrating body of the vibrator to cancel a counteraction from its surrounding portion, and may be a so-called MFB circuit disclosed in Japanese Patent Publication No. Sho 58-31156.

We claim:

1. An acoustic apparatus, comprising:

a housing having a plurality of cavities therein defining a plurality of resonators for generating an acoustic wave by resonance, wherein each of said cavities includes an acoustic mass means for causing said cavity to acoustically communicate with an external region, said plurality of resonators having different resonance frequencies and having resonance acoustic radiation portions arranged adjacent to each other and each having an end opening to an outside of the housing; and a vibrator having a front surface for driving one of said resonators and an opposing rear surface for driving another of said resonators.

2. An apparatus according to claim 1, wherein said plurality of resonators are driven in parallel by a single vibrator, and said vibrator is driven by electrical driving means to substantially cancel an air counteraction from said resonators when said resonators are driven.

3. An apparatus according to claim 1, wherein said resonance acoustic radiation portions of said resonators are coaxially arranged.

4. An apparatus according to claim 1, wherein said housing includes a partition plate therein to define first and second cavities, said plate having an opening on which said vibrator is mounted, a first duct constituting one of said acoustic mass means, said first duct being connected to said first cavity, said first cavity constituting a first one of said resonators, and a second duct constituting another one of said acoustic mass means, said second duct having an inner end and an outer end, said second duct extending through said vibrator and being arranged so that said inner end extends into said second cavity and said outer end extends into said first duct, said second cavity constituting a second one of said resonators.

5. An apparatus according to claim 1, wherein said housing includes a partition plate therein to define first and second cavities, said plate having an opening on which said vibrator is mounted, a first duct constituting one of said acoustic mass means, said first duct being connected to said first cavity, said first cavity constituting a first one of said resonators, and a second duct constituting another one of said acoustic mass means, said second duct having an inner end and an outer end, said second duct extending through a portion of said partition plate spaced from said vibrator and being arranged so that said inner end extends into said second cavity and said outer end extends into said first duct, said second cavity constituting a second one of said resonators.

6. An apparatus according to claim 1, wherein said resonance acoustic radiation portions of said resonators are juxtaposed.

7. An apparatus according to claim 1, wherein said housing includes a partition plate therein to define first and second cavities, said plate having an opening on which said vibrator is mounted, a first duct constituting one of said acoustic mass means, said first duct being connected to said first cavity, said first cavity constituting a first one of said resonators, and a second duct constituting another one of said acoustic mass means, said second duct having an inner end and an outer end, said second duct extending through a portion of said partition plate space from said vibrator and being arranged so that said inner end is connected to the second cavity and said outer end is juxtaposed with said first duct, said second cavity constituting a second one of said resonators.

8. An acoustic apparatus, comprising:

a housing having a plurality of cavities defining a plurality of resonators for generating an acoustic wave by combining resonance sounds from said resonators, each of said cavities having an acoustic mass means for communicating with an external region, said resonators being tuned to different resonant frequency ranges which overlap one another for extending low frequency response and having acoustic radiation portions arranged adjacent to each other and each having an opening to an outside of the housing; and a vibrator having a front surface for driving one of said resonators and an opposing rear surface for driving another of said resonators.

* * * * *